US007950376B2

(12) United States Patent
Rollet

(10) Patent No.: US 7,950,376 B2
(45) Date of Patent: May 31, 2011

(54) DEVICE FOR DISTRIBUTING RECIRCULATED GASES, DEVICE FOR COOLING RECIRCULATED GASES AND METHOD OF RECIRCULATING EXHAUST GASES

(75) Inventor: Bernard Rollet, Le Plessis Pate (FR)

(73) Assignee: Renault s.a.s., Boulogne Billancourt (FR)

( * ) Notice: Subject to any disclaimer, the term of this patent is extended or adjusted under 35 U.S.C. 154(b) by 432 days.

(21) Appl. No.: 12/088,169

(22) PCT Filed: Oct. 2, 2006

(86) PCT No.: PCT/FR2006/050979

§ 371 (c)(1),
(2), (4) Date: Jul. 28, 2008

(87) PCT Pub. No.: WO2007/039702

PCT Pub. Date: Apr. 12, 2007

(65) Prior Publication Data

US 2009/0007891 A1 Jan. 8, 2009

(30) Foreign Application Priority Data

Sep. 30, 2005 (FR) ..... 05 52970

(51) Int. Cl.
*F02M 25/07* (2006.01)

(52) U.S. Cl. ..... 123/568.12; 60/278

(58) Field of Classification Search ..... 123/568.11, 123/568.12, 568.2, 568.21, 568.23, 568.24, 123/563; 60/599, 605.2, 278, 279
See application file for complete search history.

(56) References Cited

U.S. PATENT DOCUMENTS

| | | | | | |
|---|---|---|---|---|---|
| 2,532,003 | A | * | 11/1950 | Wyer | 137/625.43 |
| 3,191,628 | A | * | 6/1965 | Kirkwood et al. | 137/625.43 |
| 3,211,217 | A | * | 10/1965 | Mckee et al. | 165/95 |
| 3,973,592 | A | * | 8/1976 | Cleaver et al. | 137/625.43 |
| 4,134,377 | A | * | 1/1979 | Bamsey et al. | 123/568.12 |
| 4,323,116 | A | * | 4/1982 | Zimmerman | 165/97 |
| 4,520,847 | A | * | 6/1985 | Baron | 137/625.43 |
| 4,543,996 | A | * | 10/1985 | Baron | 137/625.43 |
| 4,972,877 | A | * | 11/1990 | Halemba et al. | 137/625.29 |
| 6,360,532 | B2 | | 3/2002 | Strahle et al. | |

(Continued)

FOREIGN PATENT DOCUMENTS

EP 1 138 888 10/2001

(Continued)

OTHER PUBLICATIONS

U.S. Appl. No. 12/088,442, filed Apr. 28, 2008, Hamadani et al.

*Primary Examiner* — Stephen K Cronin
*Assistant Examiner* — Arnold Castro
(74) *Attorney, Agent, or Firm* — Oblon, Spivak, McClelland, Maier & Neustadt, L.L.P.

(57) ABSTRACT

A device for distributing recirculated gases to a component of an exhaust gas recirculation system. The device includes an inlet and an outlet for recirculated gases, an inlet port and an outlet port to the component, and a mechanism to reverse the stream of recirculated gases flowing through the component. A device for cooling recirculated exhaust gases is equipped with a mechanism to reverse the stream of recirculated gases inside the exchanger. A method of recirculating exhaust gases includes cleaning the EGR system, which is triggered by an electronic unit, and which includes reversing the stream of EGR gases flowing through an EGR cooling device.

16 Claims, 4 Drawing Sheets

U.S. PATENT DOCUMENTS

| | | | | |
|---|---|---|---|---|
| 6,401,754 | B1 * | 6/2002 | Winquist et al. | 137/625.47 |
| 6,675,572 | B2 * | 1/2004 | Everingham et al. | 60/278 |
| 6,698,452 | B2 * | 3/2004 | Sisk et al. | 137/625.43 |
| 6,904,898 | B1 * | 6/2005 | Sahlen | 123/568.12 |
| 6,955,213 | B2 * | 10/2005 | Stonehouse et al. | 165/103 |
| 7,077,114 | B2 * | 7/2006 | Husges | 123/568.12 |
| 7,117,882 | B2 * | 10/2006 | Blomgren | 137/311 |
| 7,281,529 | B2 * | 10/2007 | Lew et al. | 123/568.12 |
| 7,370,644 | B2 * | 5/2008 | Wang | 123/568.12 |
| 7,438,062 | B2 * | 10/2008 | Okawa et al. | 123/568.12 |
| 7,581,533 | B1 * | 9/2009 | Moran | 123/568.12 |
| 7,621,264 | B2 * | 11/2009 | Balsdon | 123/568.12 |
| 7,770,563 | B2 * | 8/2010 | Hamadani et al. | 123/568.12 |
| 2005/0039729 | A1 * | 2/2005 | Rosin et al. | 123/568.12 |
| 2005/0056263 | A1 | 3/2005 | Kennedy | |
| 2005/0235973 | A1 * | 10/2005 | Husges | 123/568.12 |
| 2007/0084206 | A1 * | 4/2007 | Lew et al. | 60/599 |
| 2008/0184974 | A1 * | 8/2008 | Kobayashi et al. | 123/568.12 |
| 2008/0216802 | A1 * | 9/2008 | Hamadani et al. | 123/568.24 |
| 2008/0289611 | A1 * | 11/2008 | Modien | 123/568.12 |
| 2009/0056682 | A1 * | 3/2009 | Okawa et al. | 123/568.12 |
| 2010/0037856 | A1 * | 2/2010 | Dickerson et al. | 123/323 |
| 2010/0126478 | A1 * | 5/2010 | Okawa et al. | 123/568.12 |

FOREIGN PATENT DOCUMENTS

| | | |
|---|---|---|
| EP | 1 251 263 | 10/2002 |
| JP | 2004 340099 | 12/2004 |

* cited by examiner

DEVICE FOR DISTRIBUTING RECIRCULATED GASES, DEVICE FOR COOLING RECIRCULATED GASES AND METHOD OF RECIRCULATING EXHAUST GASES

BACKGROUND

The present invention relates to devices for recirculating exhaust gases, called exhaust gas recirculation (EGR), and more particularly to EGR gas devices that have an EGR gas cooler.

In order to improve the decontamination of exhaust gases of an internal combustion engine, use is made of exhaust gas recirculation into the intake, that is generally called an EGR circuit. Moreover, the use of specific coolers for these gases makes it possible to increase this decontamination still further.

However, a major problem is that exhaust gas recirculation brings about considerable fouling of components that are located within this EGR circuit. This is why cleaning/decarbonizing steps may be carried out by completely opening the EGR valve (the EGR valve regulates the flow of EGR gas which is distributed to the intake) when the engine is on a set operating zone. This method, described in application FR2833653, makes it possible to remove deposits thermally that accumulate in the EGR circuit.

This fouling problem is not however completely solved as regards the EGR cooler. The cooler is constantly operating, that is to say there is always a flow of water passing through the exchanger. What happens then is that the cooler is perfectly decarbonized at the inlet when a cleaning phase is carried out, but the EGR gases that are constantly cooled are not hot enough to decarbonize the EGR cooler completely, especially in the second half of the EGR water/gas exchanger.

Document JP20043400099 relates to an EGR system of an internal combustion engine having two separate sets of cylinders. This EGR system has the peculiarity of being able to reverse the flow of exhaust gas circulating in the duct and consequently in the coolers, by modifying the exhaust gas pressures between the first and second set of cylinders. A major disadvantage is that it is necessary to have two separate sets of cylinders available in which the exhaust gas pressures can be modified.

BRIEF SUMMARY

The invention aims to solve the problem of fouling of EGR coolers.

With this objective, the invention provides a device for distributing EGR gases, the device having an EGR gas inlet and an EGR gas outlet, an inlet port and an outlet port to a component, such as an EGR cooler, and means for reversing the flow of EGR gases in this component.

The invention also provides a cooler for recirculating gases that has means for reversing the flow of recirculated gases circulating in the heat exchanger.

The invention also provides a method for recirculating exhaust gases, the method including a step for cleaning the EGR circuit triggered by an electronic unit, the cleaning step including a step for reversing the flow of EGR gases passing through an EGR coolant.

BRIEF DESCRIPTION OF THE DRAWINGS

The present invention and its advantages will be better understood on reading the detailed description of an embodiment taken as an example and in no way limiting, and illustrated by the appended drawings in which.

DETAILED DESCRIPTION

Figure 1:
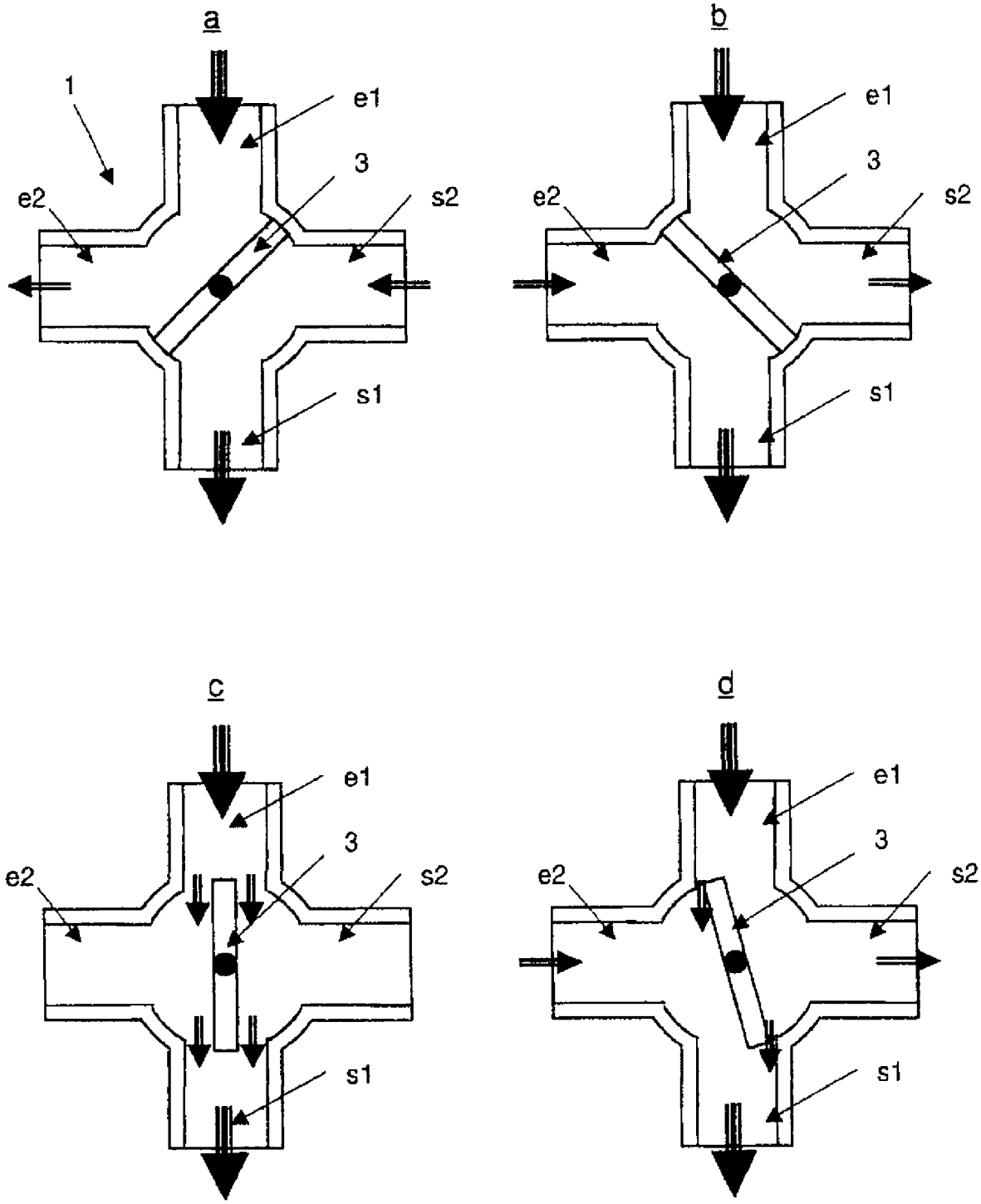
FIG. 1 is a diagram of the distribution device according to the invention.

FIG. 1 shows the device 1 for distributing gases recirculated to a component (not shown) of the EGR circuit according to the invention.

The device 1 has an inlet e1 and an outlet s1 for recirculated gases, an inlet port e2 and an outlet port s2 to the component, and means for reversing the flow of recirculated gases circulating in the component.

The means for reversing the flow of recirculated gases may include a valve that is moveable in rotation. The valve may be represented in the form of a flap 3 pivoting on itself inside a cylinder formed in the device 1. The pivoting flap 3 thus divides the cylinder into two separate volumes. The inlet e1 for recirculated gases emerges in the cylinder and is located facing the outlet s1 for recirculated gases. The inlet port e2 for gases recirculated in the component is defined on the cylinder between the inlet e1 and the outlet s1, and is located facing the outlet s2. The position of the flap 3 defines the circulation of the flow of recirculated gases.

The valve can move in rotation between two positions.

The first position is represented in FIG. 1*a*. In this position, the flap is inclined at +45° (taken in the trigonometric direction in relation to an imaginary vertical axis). On the one hand it is the inlet e1 for recirculated gases and the inlet port e2 to the component that are in communication and, on the other hand it is the outlet port s2 to the component and the outlet s1 for recirculated gases that are in communication.

The second position is shown in FIG. 1*b*. In this position, the flap is inclined at −45°. On the one hand it is the inlet e1 for recirculated gases and the outlet port s2 to the component that are in communication and on the other hand it is the inlet port e2 to the component and the outlet s1 for recirculated gases that are in communication.

With reference to FIG. 1*c*, the valve that is moveable in rotation may also possess an intermediate position making it possible to bypass the component, in this way conferring a supplementary bypass function that is directly incorporated in the device. The flap is at 0° and there is then the flow of recirculated gases that arrives from the inlet e1 and that is directed directly to the outlet s1 without passing through the ports e2 and s2.

The valve may also be of the proportional valve type. With reference to FIG. 1*d*, intermediate positions may therefore be defined (between 0° and −45°, and in the same way between 0° and +45°), for example in order partially to cool the recirculated gases when the component is an EGR cooler.

The invention also concerns an EGR gas cooler that includes means for reversing the flow of EGR gases circulating in the heat exchanger of the cooler.

Figure 2:
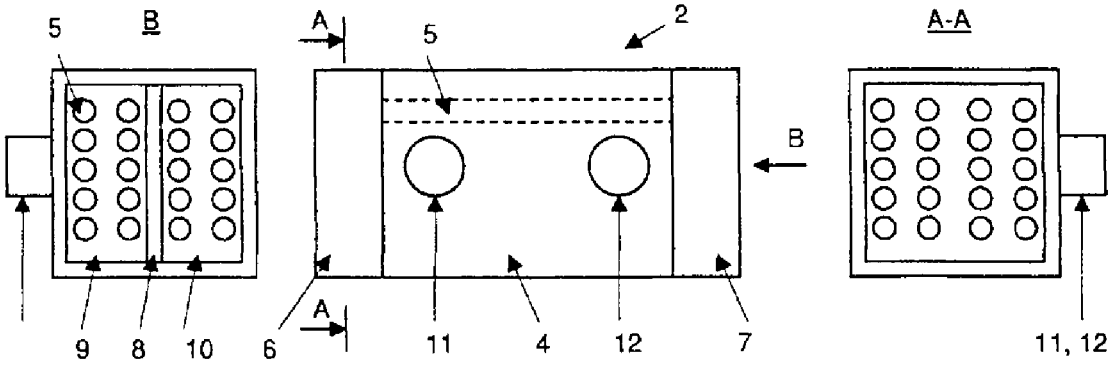
FIG. 2 is a diagram of a U-shaped EGR cooler.

According to a non-limiting embodiment, the cooler is configured in a U. With reference to FIG. 2, the cooler 2 has a heat exchanger 4. The heat exchanger 4 corresponds to a closed chamber that is traversed by a plurality of tubes 5 inside which the recirculated gases circulate. The tubes 5 separate the recirculated gases from the cooling fluid that flows in the exchanger between an inlet port 11 and an outlet port 12 defined on the closed chamber. In this embodiment, in order to produce the U-shape, a separating partition 8 is disposed in the region of the volume 7 on an end surface of the exchanger 4. This partition 8 thus defines an inlet chamber 9 for recirculated gases and an outlet chamber 10 for recirculated gases that are substantially equal. A cover 6 for returning gases is disposed at the other end surface of the exchanger 4. The inlet and outlet for exhaust gases of the exchanger 4 are located on the same plane, separation being achieved by the partition 8.

Figure 4:
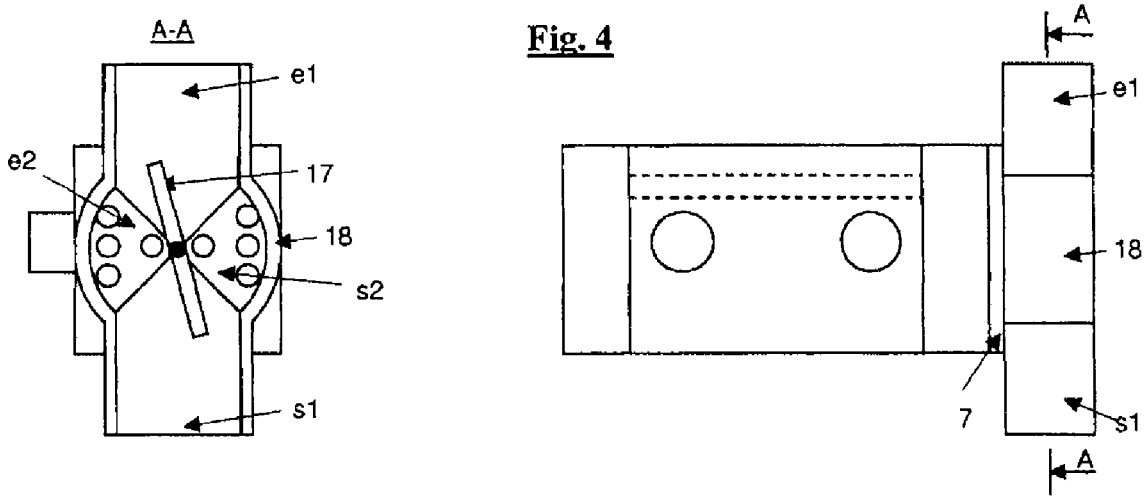

The means for reversing the flow of recirculated gases include a valve of the type previously described, that is to say with reference to FIG. 4, that consists of a flap 17 that pivots on itself inside a cylinder 18. The axes of the flap 17 and the cylinder 18 are coaxial.

Figure 3:
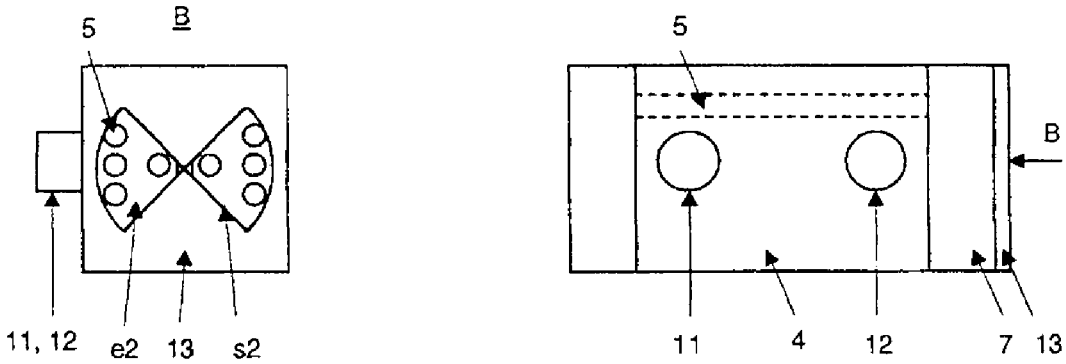
FIGS. 3 and 4 are diagrams of the EGR cooler with means for reversing the flow of recirculated gases.

With reference to FIG. 3, the valve also includes a disc 13 (or plate 13) covering the inlet and outlet of the cooler 2. The disc 13 closes the volume 7 of the cooler 2. This disc defines at least two openings e2 and s2, one e2 communicating with the gas inlet chamber 9 and the other s2 communicating with the gas outlet chamber 10. These openings e2 and s2 may be of the quadrant type, so as to cooperate with the positions of the flap 17.

With reference to FIG. 4, which shows the final assembly of the cooler according to the invention, the axis of the flap 17 is perpendicular to the disc 13. The cylinder 18 defines the inlet e1 and the outlet s1 for recirculated gases. Considering the flap 17 rotating in the cylinder 18, the inlet e1 and the outlet s1, the inlet port e2 and the outlet port s2, the principle will be recognized again for the distribution of recirculated gases described above with the aid of FIG. 1. The difference lies in the production of the ports e2 and s2, since they are defined on the disc 13. The disc 13 forms the bottom of the cylinder 18, and it may be envisaged that the disc 13 and the cylinder 18 are made together in a single piece.

Figure 7:
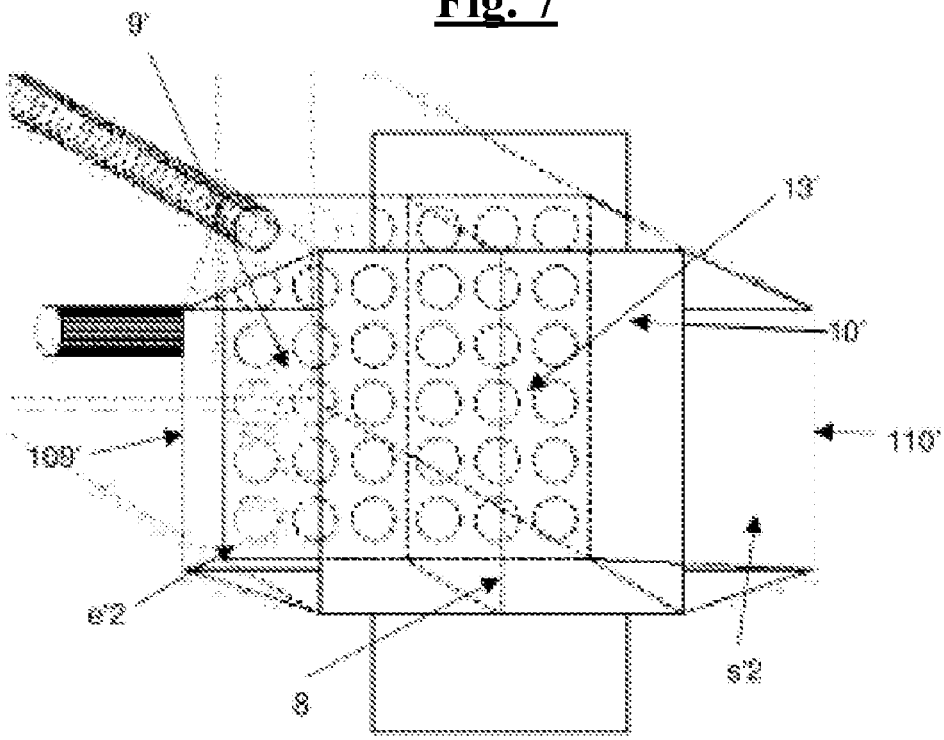
FIGS. 7 and 8 show a variant of an embodiment of openings and inlet and outlet chambers of the cooler.
Figure 8:
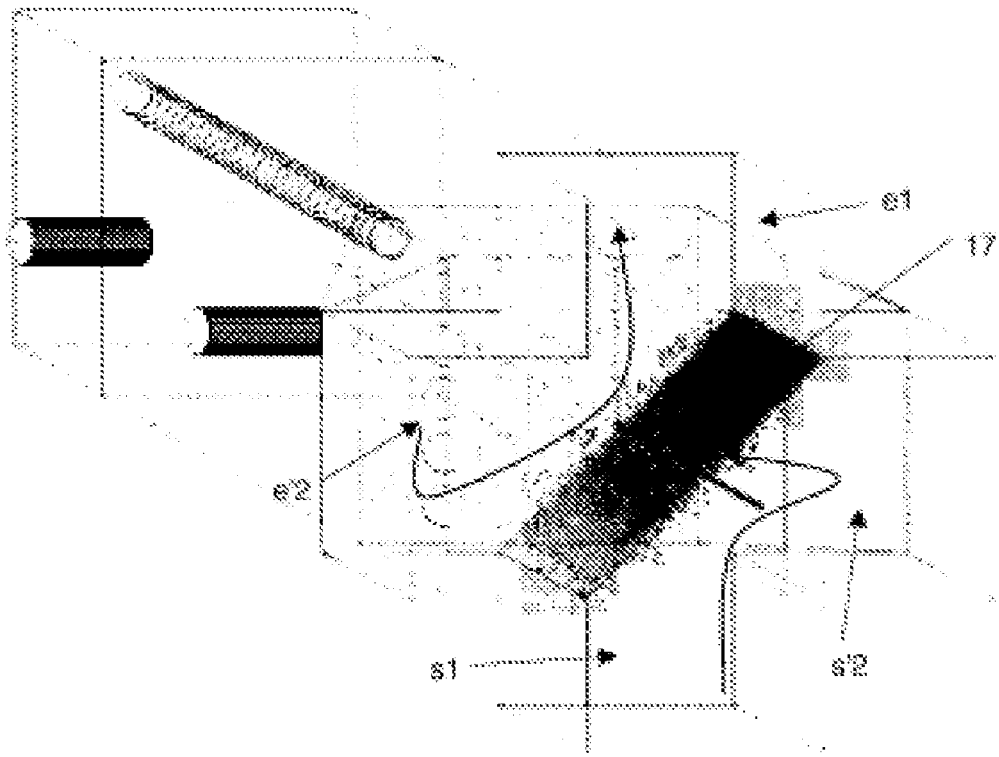

FIGS. 7 and 8 show a variant of an embodiment of the openings and inlet and outlet chambers of the cooler. The partition 8 defines the inlet chamber 9' and the outlet chamber 10'. These chambers are flared out on the side so that the edges 109' and 110' have an angle of inclination with respect to the partition 8. The plate 13' covers the two chambers 9' and 10' and it defines two openings e'2 and s'2. These openings are offset on the sides by at least one half length of the pivoting flap 17. This variant makes it possible to reduce pressure losses in order to promote the flow of recirculated gases, as shown in FIG. 8. This variant thus repeats the principle of FIG. 1, with openings offset with respect to the openings of FIG. 4.

Figure 5:
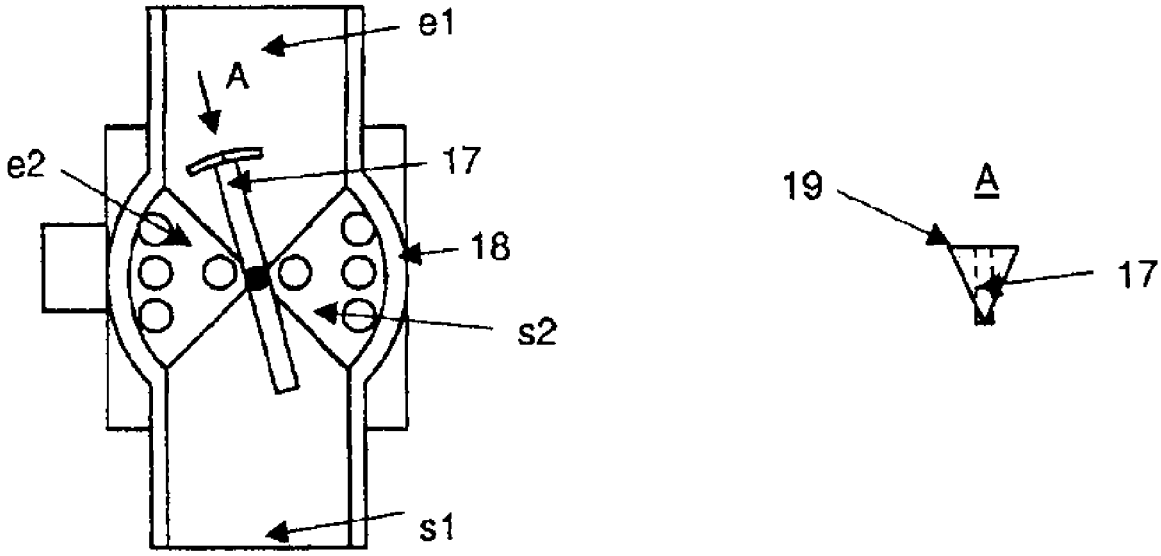
FIGS. 5 and 6 are variants of embodiments of the EGR cooler.

According to a supplementary feature, the valve may include means for increasing the precision of the distribution of the flow of gases recirculated at small openings thereof. According to a first embodiment shown in FIG. 5, it is possible to add onto one end of the flap 17, a plate 19 perpendicular to the flap 17, of which the curvature matches that of the inner wall of the cylinder 18. The plate 19 may for example have a triangular shape arched on the flap 17. The advantage of adding this plate 19 to the flap 17 is that it makes it possible to increase the precision of variations in the flow distribution at small openings in relation to the first and second positions of the flap 17.

Figure 6:
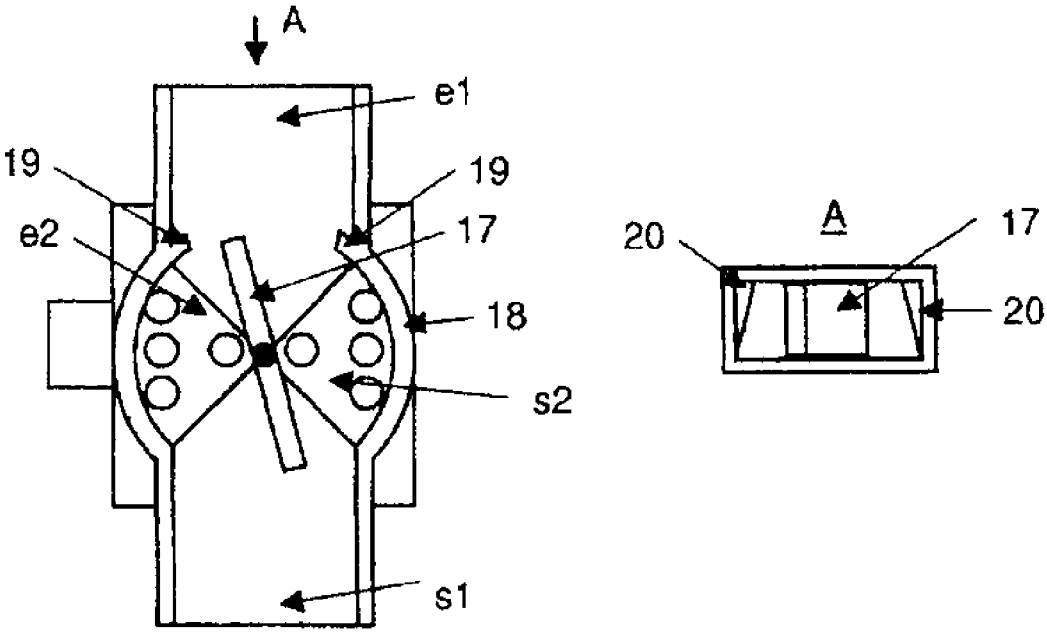

Another embodiment shown in FIG. 6 may be envisaged. The triangular shape may be divided into equal parts 20, each of the parts 20 then being positioned on one side of the end of the inlet e1 or of the outlet s1 emerging in the cylinder 18.

These two embodiments permit greater precision over the control of recirculated gas flows, between those that are bypassed and those that are cooled (in the case where a valve of the proportional type is used and by virtue of which it is possible to regulate the temperature of recirculated gases), and better control over variations in the cooling of gases.

The invention also relates to a method for recirculating exhaust gases, the method including a step for cleaning the EGR circuit triggered by an electronic unit. The cleaning step may commence for example when the temperature of the recirculated gases is sufficient to remove soot deposits, and this information may be provided by a temperature sensor of the engine. According to the invention, the cleaning step includes a step for reversing the flow of EGR gases passing through an EGR cooler. The reversing step may be triggered at the end of a predetermined period from the triggering of the cleaning step.

The recirculation method may act directly on the means for driving the flap 17 of the recirculated gas cooler 2. These drive means may consist for example of an electric motor (or servomotor) that causes the axis of the flap 17 to rotate. The computer (not shown) may thus control the electric motor in order to cause the flap 17 to pivot from its first to its second position and thus to reverse the flow of recirculated gases. This action, or flow reversing step, may proceed at the end of a predetermined time that is recorded in the memory of the computer. Provision may also be made to use other ways of triggering this reversing step during the cleaning phase, by using for example temperature or pressure sensors, etc.

The method may also provide a step for cleaning the valve represented by the flap 17 during this phase of cleaning the recirculated gas circuit. The computer may control the electric drive motor so as to make it perform at least one complete rotation in order to remove any soot deposits.

The method may also control the flap outside a cleaning step by alternating, for example each time the engine starts again, the position of the flap between the first and second position. To this end, the method includes a step of reversing the flow of recirculated gases in the cooler at each new engine start. An advantage of this feature is that natural fouling of the cooler is distributed in a more uniform manner in the region of the inlet and also of the outlet for recirculated gases.

With all these elements, the computer may control the valve in the following manner over an operating cycle of the engine:

- before the engine starts, putting the cooler in the bypass position,
- then, when the operating conditions are reached, (for example, when a threshold is exceeded for the temperature of the cooling fluid representative of the heating of the engine) rotating the flap in order to put it either into the first or into the second position. The position of the flap is a function of the last of the two possible positions recorded by the computer. Or it can be put into an intermediate position (in the case of a valve of the proportional type) so as to perform controlled cooling, but still beside the position opposite the last position (first or second) recorded by the computer.
- triggering a cleaning step when the temperature of recirculated gases is sufficient, or also even when another condition is fulfilled, as for example certain mileage of the vehicle, or again when a differential pressure threshold representative of fouling of the EGR cooler is exceeded.
- triggering of the step of reversing the flow in the cooler, at the end of a certain time.

The invention claimed is:

1. A device for distributing recirculated gases to a cooler of an EGR circuit having a heat exchanger, comprising:

an inlet;

an outlet for recirculated gases;

an inlet port and an outlet port to the cooler; and a valve to reverse flow of recirculated gases circulating in the heat exchanger of the cooler, the valve being moveable in rotation between a first position wherein the inlet for recirculated gases and the inlet port to the cooler and the outlet port to the cooler and the outlet for recirculated gases are in communication, and a second position wherein the inlet for recirculated gases and the outlet port to the cooler and the inlet port to the cooler and the outlet for recirculated gases are in communication.

2. The device as claimed in claim 1, wherein the valve that is moveable in rotation possesses an intermediate position enabling the cooler to be bypassed.

3. The device as claimed in claim 2, wherein the valve is of proportional type.

4. A cooler for recirculated gases, comprising:

a heat exchanger configured in a U shape; and a valve to reverse a flow of recirculated gases circulating in the heat exchanger, the valve including a disc covering an inlet and outlet of the cooler and that defines at least first and second openings, the first opening communicating with a gas inlet chamber and the second opening communicating with a gas outlet chamber, and a flap pivoting about an axis perpendicular to the disc inside a cylinder, the cylinder defining an inlet port and outlet port for EGR gases.

5. The cooler as claimed in claim 4, wherein the valve includes means for increasing precision of distribution of the flow of recirculated gases at small openings thereof.

6. The cooler as claimed in claim 4, wherein the valve includes a plate on an end of the flap to increase precision of distribution of the flow of recirculated gases at small openings of the valve.

7. The cooler as claimed in claim 4, wherein side walls of the inlet port of the cylinder are triangular to increase precision of distribution of the flow of recirculated gases at small openings of the valve.

8. The cooler as claimed in claim 4, wherein side walls of the outlet port of the cylinder are triangular to increase precision of distribution of the flow of recirculated gases at small openings of the valve.

9. The cooler as claimed in claim 4, wherein the heat exchanger includes a plurality of tubes inside which the recirculated gases circulate.

10. The cooler as claimed in claim 4, wherein the heat exchanger includes a separating partition to divide the heat exchanger into the U shape.

11. The cooler as claimed in claim 4, wherein the axis of the flap is coaxial with an axis of the cylinder.

12. A method for recirculating exhaust gases, comprising:

cleaning an EGR circuit triggered by an electronic unit when temperature of the recirculated gases is sufficient to remove soot deposits; and the cleaning including reversing flow of EGR gases passing through an EGR cooler by rotating a valve from a first position wherein an inlet for recirculated gases and an inlet port to the cooler and an outlet port to the cooler and an outlet for recirculated gases are in communication to a second position wherein the inlet for recirculated gases and the outlet port to the cooler and the inlet port to the cooler and the outlet for recirculated gases are in communication.

13. The method as claimed in claim 12, wherein the reversing is triggered at an end of a predetermined period from triggering of the cleaning.

14. The method as claimed in claim 12, further comprising reversing the flow of recirculated gases in the cooler each time an engine that produces the exhaust gases starts again.

15. The cooler as claimed in claim 6, wherein the plate is curved at a curvature that matches a curvature of an inner wall of the cylinder.

16. The cooler as claimed in claim 6, wherein the plate is triangular.

* * * * *